US007966735B1

(12) United States Patent
Hayes

(10) Patent No.: US 7,966,735 B1
(45) Date of Patent: Jun. 28, 2011

(54) SCISSORS ASSEMBLY WITH ROTATABLE BLADES

(75) Inventor: Grady Hayes, East Greenwich, RI (US)

(73) Assignee: Hasbro, Inc., Pawtucket, RI (US)

( * ) Notice: Subject to any disclaimer, the term of this patent is extended or adjusted under 35 U.S.C. 154(b) by 412 days.

(21) Appl. No.: 12/098,143

(22) Filed: Apr. 4, 2008

(51) Int. Cl.
*B26B 13/00* (2006.01)
*B26B 13/10* (2006.01)
*B25G 3/38* (2006.01)

(52) U.S. Cl. ..... 30/254; 30/341

(58) Field of Classification Search ..... 30/177, 30/199, 341, 252, 194, 230–235, 268, 350, 30/254–258, 131, 195, 229; D8/57, 14, 58, D8/105, 107; D21/532; 7/135, 136; 140/119, 140/122
See application file for complete search history.

(56) References Cited

U.S. PATENT DOCUMENTS

| | | | | | |
|---|---|---|---|---|---|
| 187,713 | A | * | 2/1877 | Kelly | 30/256 |
| 733,919 | A | * | 7/1903 | Schwartz | 30/252 |
| 756,818 | A | | 4/1904 | Benton | |
| 869,949 | A | * | 11/1907 | Westerdahl | 30/257 |
| 1,284,351 | A | * | 11/1918 | Jagielo | 30/259 |
| 1,326,299 | A | * | 12/1919 | Smit | 30/256 |
| 1,507,529 | A | * | 9/1924 | Sundman | 30/252 |
| 2,020,242 | A | * | 11/1935 | Geddes | 30/177 |
| 3,092,152 | A | * | 6/1963 | Neff | 140/119 |
| 3,159,060 | A | | 12/1964 | Miles | |
| 3,520,058 | A | * | 7/1970 | Pfaffenbach | 30/134 |
| 3,978,584 | A | * | 9/1976 | Mayer | 30/256 |
| D258,931 | S | * | 4/1981 | Hawkins | D8/57 |
| 4,326,335 | A | * | 4/1982 | Morton | 30/254 |
| D277,203 | S | | 1/1985 | Paczko | |
| D301,348 | S | * | 5/1989 | Li et al. | D21/532 |
| D303,486 | S | * | 9/1989 | Wang | D8/57 |
| D304,744 | S | * | 11/1989 | Ukisu | D21/532 |
| 5,060,381 | A | * | 10/1991 | Taberlet | 30/232 |
| D323,004 | S | * | 1/1992 | Ricci | D21/532 |
| 5,159,757 | A | * | 11/1992 | Weid et al. | 30/251 |
| 5,168,629 | A | * | 12/1992 | Willard | 30/254 |
| 5,659,959 | A | * | 8/1997 | Parlowski | 30/232 |
| 5,758,422 | A | * | 6/1998 | Frank | 30/230 |
| 6,021,693 | A | * | 2/2000 | Feng-Sing | 76/106.5 |
| D426,123 | S | * | 6/2000 | Gstadler | D8/57 |
| 6,131,223 | A | * | 10/2000 | Rehkemper et al. | 7/158 |
| 6,139,397 | A | | 10/2000 | Blau et al. | |
| 6,249,976 | B1 | * | 6/2001 | Osame | 30/199 |
| 6,393,703 | B1 | * | 5/2002 | Wu | 30/232 |
| 6,481,106 | B1 | * | 11/2002 | Paloheimo et al. | 30/199 |
| 6,662,451 | B1 | * | 12/2003 | Cheng | 30/199 |
| 7,032,316 | B1 | * | 4/2006 | Tseng | 30/230 |
| D589,770 | S | * | 4/2009 | Hayes | D8/57 |
| 7,574,805 | B1 | * | 8/2009 | Lindroth | 30/192 |

(Continued)

FOREIGN PATENT DOCUMENTS

| | | | | |
|---|---|---|---|---|
| FR | 2820677 | A1 | * | 8/2002 |
| GB | 2348390 | A | * | 10/2000 |
| WO | WO 8702613 | A1 | * | 5/1987 |

*Primary Examiner* — Jason Daniel Prone
(74) *Attorney, Agent, or Firm* — Perry Hoffman

(57) ABSTRACT

A toy scissors apparatus for modeling compound. The scissors apparatus has two handles, each handle connected to a respective mounting cap and to a respective rotatable scissor blade. Each of the blades is rotatable about its longitudinal axis between two positions about 180° apart so as to enable a choice of two different cutting edge regions for use. To alter cutting edges, the blade is pulled away from the mounting cap against a biasing force created by a spring, and then rotated.

20 Claims, 2 Drawing Sheets

U.S. PATENT DOCUMENTS

2002/0023354 A1* 2/2002 Lowe et al. ..... 30/142
2003/0014868 A1* 1/2003 Cech et al. ..... 30/341
2005/0241158 A1* 11/2005 Demar et al. ..... 30/341
2005/0283981 A1* 12/2005 Yizhar ..... 30/142
2006/0277764 A1* 12/2006 Hsien ..... 30/245
2010/0319202 A1* 12/2010 Lin ..... 30/254

* cited by examiner

FIG. 1
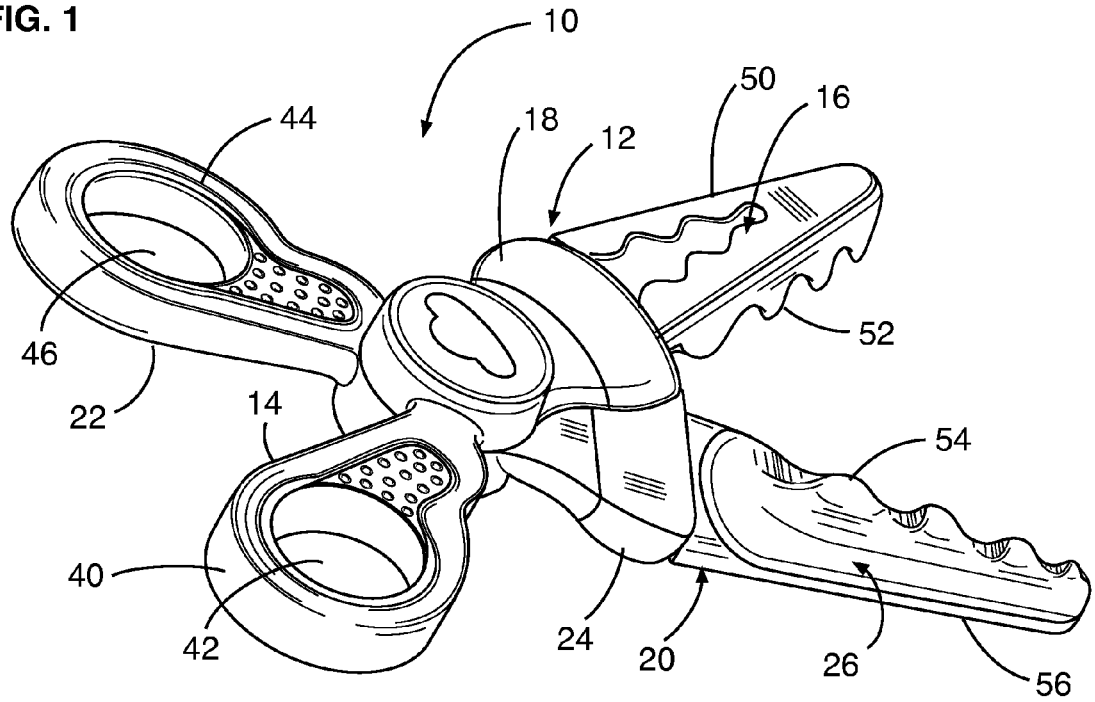
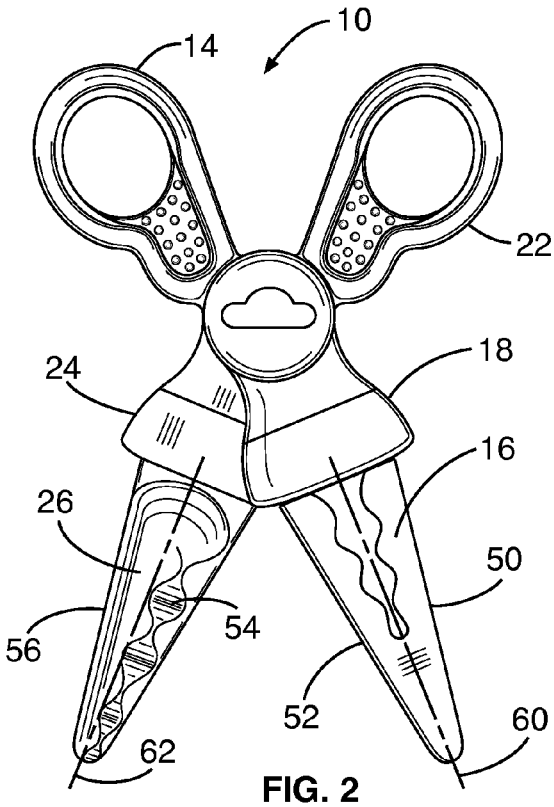
FIG. 2
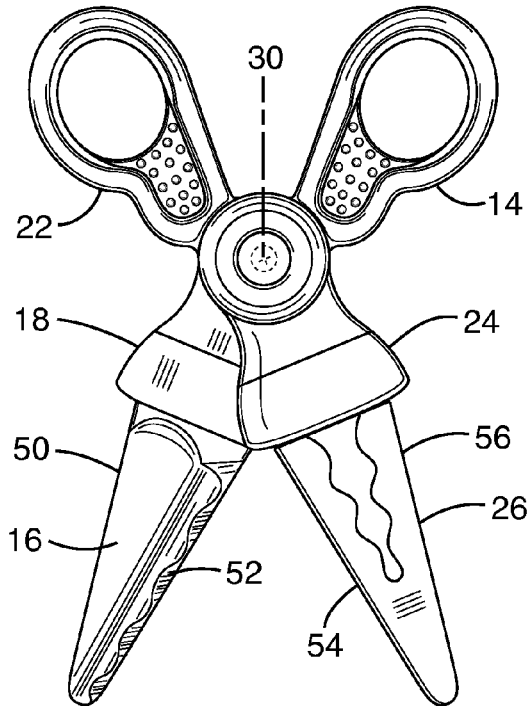
FIG. 3

SCISSORS ASSEMBLY WITH ROTATABLE BLADES

FIELD OF THE INVENTION

The present invention relates generally to a pair of scissors, and more particularly, to a scissors assembly with rotatable blades that provides for changeable cutting edges.

BACKGROUND OF THE INVENTION

Modeling compound, such as that marketed under the PLAY-DOH brand by Hasbro, Inc., is a popular play item with great play value. Modeling compound allows children to use their imagination to fashion various figures and designs. Working with modeling compound also enhances hand-eye coordination and dexterity. Over the years, various devices have been created to enhance the play value of modeling compound, such as stamping devices, extruders and molds to facilitate the creation and forming of different designs and configurations.

Scissors are well known in general, and are also known for use as a toy and for use as an adult tool. For example, a 1904 U.S. Pat. No. 756,818, issued to Benton for "Cutting Shears" purports to disclose an adult tool, while a Patent issued in 2000, No. 6,139,397, to Blau et al., for a "Doll Having Simulated Hair-Cutting Feature" discloses a toy. Other Patents relating to toys include No. D277,203, issued in 1985 to Paczko, illustrating a "Toy Pliers," No. D304,744, issued in 1989 to Ukisu, showing a "Toy Scissors," and No. D323,004, issued in 1991 to Ricci, for a "Toy Shears."

These disclosures are interesting, but none disclose devises that have particular play value with modeling compound, or the simplicity, low cost, and robustness desired for such a toy item. In addition, none of the patents disclose a more efficient adult tool for cutting material.

SUMMARY OF THE INVENTION

In accordance with the present invention, an advantageous apparatus is provided that enhances the play value of modeling compound; the present invention also provides an advantageous method for efficiently assembling a scissors apparatus. A described preferred embodiment set forth below includes a pair of scissors illustrated as a toy. The pair of scissors is especially designed and constructed for safe use by young children, although it is noted that the invention may also be applied to an adult tool as well, and such an apparatus may have many uses beyond having a child with the scissors interacting with modeling compound.

Briefly summarized, the invention includes a scissors assembly comprising a first handle, a first blade having a longitudinal axis mounted to the first handle to enable the first blade to rotate about its longitudinal axis between two positions, a second handle pivotally connected to the first handle, and a second blade having a longitudinal axis mounted to the second handle to enable the second blade to rotate about its longitudinal axis between two positions as well. The embodiment illustrated below is safe, provides variety, and has great play value. The embodiment illustrated also is easy to use and has a robust construction.

The invention also relates to a method for mounting the scissor blade to the scissor handle to enable the scissor blade to be rotated around its longitudinal axis, the method comprising the steps of connecting a scissor blade to a mounting cap with a fastener and a coiled compression spring by placing the fastener through the coiled spring and through an opening in the mounting cap for connecting the fastener to the scissor blade such that the spring is captured between the fastener and the mounting cap, and thereafter connecting the mounting cap to the scissor handle. The embodiment illustrated below is simple and easy to assemble and is inexpensive.

BRIEF DESCRIPTION OF THE DRAWINGS

For the purpose of facilitating an understanding of the invention, the accompanying drawings and description illustrate a preferred embodiment thereof, from which the invention, its structures, its construction and operation, its processes, and many related advantages may be readily understood and appreciated.

FIG. 1 is an isometric view of a preferred embodiment of a pair of scissors;

FIG. 2 is a top plan view of the pair of scissors shown in FIG. 1;

FIG. 3 is a bottom plan view of the pair of scissors shown in FIGS. 1 and 2;

DESCRIPTION OF THE PREFERRED EMBODIMENTS

Figure 4:
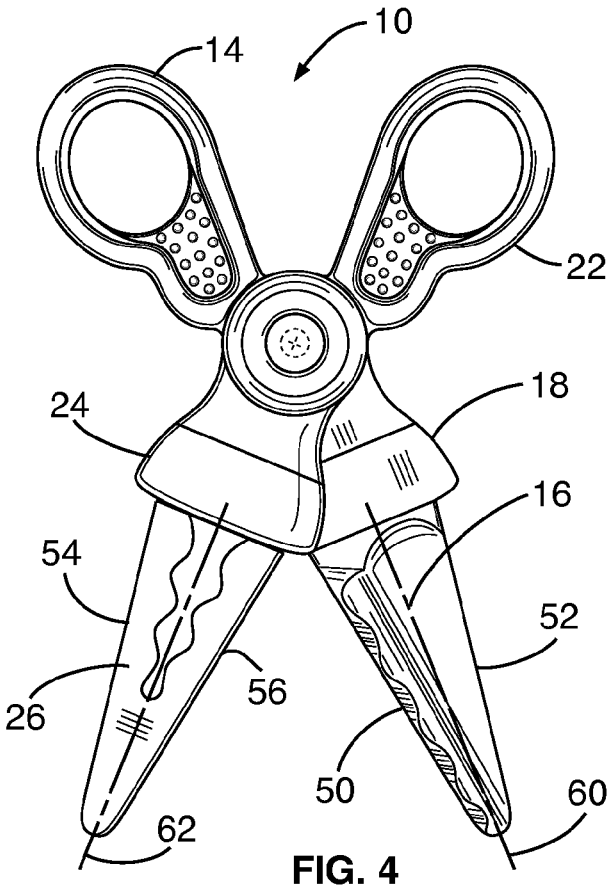
FIG. 4 is a top plan view of the pair of scissors shown in FIGS. 1-3 with blades rotated 180°.

The following description is provided to enable those skilled in the art to make and use the described embodiment set forth in the best mode contemplated for carrying out the invention. Various modifications, equivalents, variations, and alternatives, however, will be readily apparent to those skilled in the art. Any and all such modifications, variations, equivalents, and alternatives are intended to fall within the spirit and scope of the present invention.

Referring now to the Figures, FIGS. 1-3 show a preferred embodiment of the invention in the form of a pair of scissors 10 (hereafter referred to as "scissors"). The scissors is shown in an isometric view in FIG. 1, and in top and bottom plan views in FIG. 2 and FIG. 3, respectively. The scissors 10 includes a first scissor 12 having a first handle 14, a first, generally triangular blade 16, and a first mounting cap 18, with the cap being located between the first handle 14 and the first blade 16. A second scissor 20 includes a second handle 22 pivotally connected to the first handle 14, a second mounting cap 24, and a second, generally triangular blade 26. A fastener, such as a screw 30, placed at the pivot or fulcrum of the scissors may be used to connect the first and the second scissors 12, 20 so that the two scissors may pivot relative to each other in the usual manner.

The first handle 14 includes a loop 40 forming an opening 42 for a finger or a thumb of a user's hand. In a like fashion, the second handle 22 has a loop 44 forming an opening 46 for a finger or a thumb. The first blade 16 includes a first edge region 50 and a second edge region 52, and the second blade 26 also includes a first edge region 54 and a second edge region 56. In the embodiment shown, the first edge region 50 of the first blade 12 is straight, and the second edge region 56 of the second blade 24 is also straight. The second edge region 52 of the first blade 12 is generally serrated, and the first edge region 54 of the second blade 26 is also generally serrated, although the serrated edge region 54 of the second blade 26 is not exactly the same shape as the serrated edge region 52 of the first blade 12. The geometry of the second edge region 52 of the first blade 12 is relatively narrow and more sharply formed, as best shown in FIG. 3, whereas the serrated edge region 54 of the second blade 26 is relatively broad and wide as shown best in FIG. 2. Alternately, the edge regions may have configurations other than serrated and straight edges. For example, the edge regions may be gear-like, or have longer or shorter wave periods, or be configured with saw teeth.

An important feature of the scissors 10 is that each of the blades may be rotated about longitudinal axes such that the cutting edges of the blades may be varied to result in different cut designs. Referring to FIG. 4, the scissors is shown in a top plan view like in FIG. 2, however, in FIG. 4, the first blade 16 and the second blade 26 are shown rotated about 180° to second positions about longitudinal axes 60, 62 of the blades 16, 26, respectively, from first positions shown in FIG. 2. The ability to rotate the blades results from an internal structure of the scissors shown in FIGS. 5 and 6, where the internal structure of the scissors is illustrated in detail.

Figure 6:
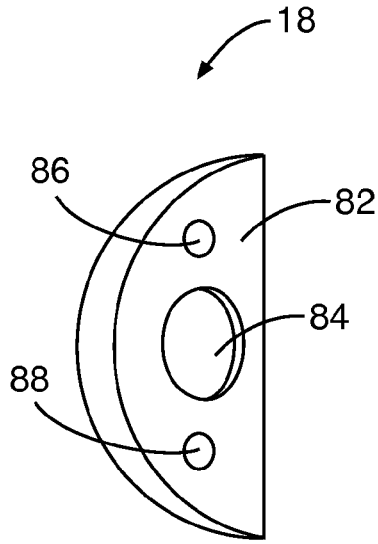
FIG. 6 is an isometric rear view of a mounting cap of the pair of scissors shown in FIG. 5.
Figure 5:
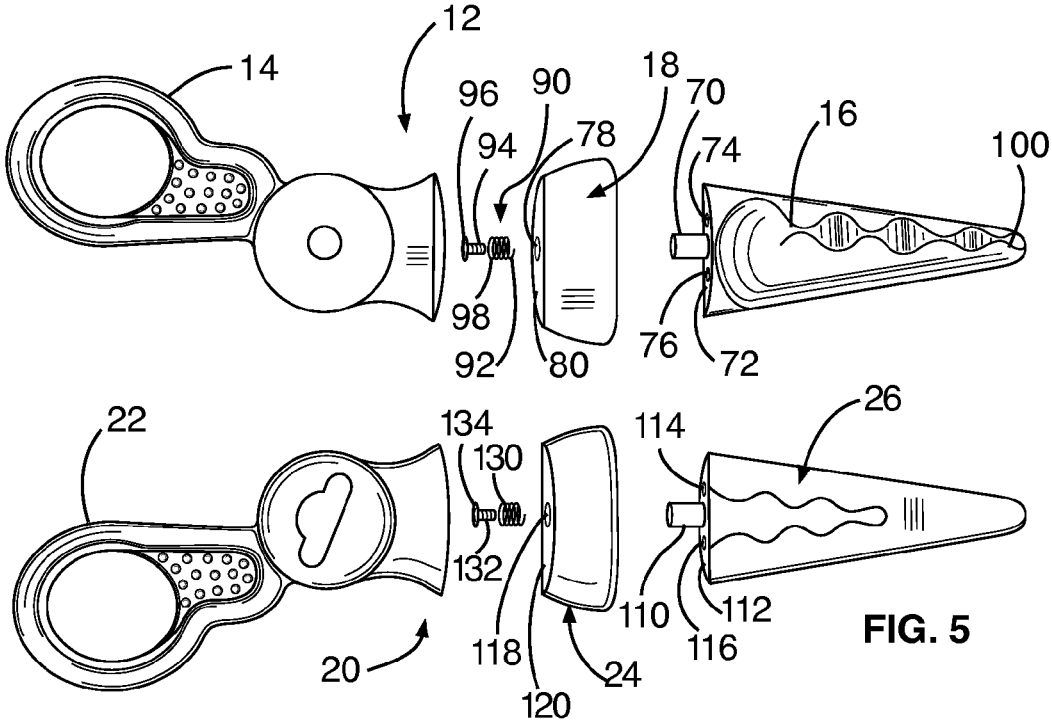
FIG. 5 is an exploded isometric front view of the pair of scissors shown in FIGS. 1-4.

The first blade 16, FIG. 5, includes a fastener receiving post 70 extending from the proximal or wide end 72 of the blade. Also extending from the wide end 72 of the first blade are two spaced apart protrusions or bumps 74, 76. The mounting cap 18 includes a fastener receiving opening 78 in a front base 80 as viewed in FIG. 5. A rear base 82 of the mounting cap 18 is shown in FIG. 6. The rear base 82 includes a larger rear opening 84 for receiving the post 70 and for acting as a bearing to the shaft-like post. The front opening 78 in the mounting cap aligns with the opening 84.

Also shown in FIG. 6, are two spaced apart recesses 86, 88 for receiving the two protrusions 74, 76 when the blade 16 and the mounting cap 18 are brought together to insure proper alignment. It is noted that the protrusions and the recesses are mateable whether the blade is positioned as shown in FIG. 2, or rotated about 180° as shown in FIG. 4. In the alternative, the protrusions may be formed on the mounting cap, and the recesses may be formed on the blade. A coiled compression spring 90 abuts the front base 80 of the cap 18 at one end 92 of the spring, and receives a fastener, such as a screw 94 having a head 96, through an opposite end 98 of the spring 90. The screw 94 extends through the spring 90, and then through the front and rear openings 78, 84 in the mounting cap, and is secured to the post 70. Upon installation of the screw 94, the spring 90 is captured between the screw head 96 and the front base 80 of the mounting cap 18.

The structural arrangement described above allows the blade 16 to be gripped at the distal or narrow end 100 and pulled away from the rear base 82 of the mounting cap 18 against the biasing force created by compression of the spring 90 developed in the pulling process plus any bias created when the screw 94 is initially installed. Once the protrusions 74, 76 disengage from the recesses 86, 88, the blade 16 may be twisted or rotated from the blade position shown in FIG. 2, to the position shown in FIG. 4, using the post 70 of the blade in the bearing-like rear opening 84 of the mounting cap for stability and alignment. When the new position is reached and the distal end 100 of the blade 16 is released, the spring 90 biases the blade toward the mounting cap and causes the protrusions and the recesses to engage. The blade may be rotated back from the position shown in FIG. 4 to the position shown in FIG. 2 by the same pull, twist and release operation.

After assembly of the screw 94, the spring 90 and the mounting cap 18 with the blade 16, the mounting cap 18 may be secured to the handle 14 by any suitable means, such as sonic welding the handle 14 to the front base 80 of the mounting cap. Alternately, an adhesive may be used, or a mechanical fastener, for example.

The second scissor 20 is constructed in a similar manner and includes the second blade 26, FIG. 5, having a fastener receiving post 110 extending from the proximal or wide end 112 of the blade. Also extending from the wide end 112 of the second blade 26 are two spaced apart protrusions 114, 116. The mounting cap 24 includes a fastener receiving opening 118 in a front base 120, as viewed in FIG. 5. A rear base (not shown) of the mounting cap 24 includes a larger rear opening for receiving the post 110 and for acting as a bearing to the shaft-like post, just as the opening 84 in the first mounting cap 18 acts in relation to the post 70. The front opening in the mounting cap 24 aligns with the rear opening in the same cap.

As with the mounting cap 18, the mounting cap 24 includes two spaced apart recesses (not shown) for receiving the two protrusions 114, 116 to insure proper alignment when the blade 26 and the mounting cap 24 are brought together. The protrusions and the recesses are mateable whether the blade is positioned as shown in FIG. 2, or rotated about 180° as shown in FIG. 4. As before, in the alternative, the protrusions may be formed on the mounting cap 24, and the recesses may be formed on the blade 26. A coiled compression spring 130 abuts the front base 120 of the cap 24, and receives a fastener, such as a screw 132 having a head 134. When the screw 132 extends through the spring 130, and then through the front and the rear openings in the mounting cap 24, and is secured to the post 110, the spring 130 is captured between the screw head 134 and front base 120 of the mounting cap 24.

The structural arrangement described above allows the blade 26 to be gripped and pulled away from the rear base of the mounting cap 24 against the biasing force created by compression of the spring 130 developed in the pulling process plus any bias created when the screw 132 is initially installed. Once the protrusions disengaged from the recesses, the blade may be twisted or rotated from the blade position shown in FIG. 2, to the position shown in FIG. 4, or from the position shown in FIG. 4 to the position shown in FIG. 2. Once the new position is reached and the blade is released, the spring biases the blade toward the mounting cap, and causes the protrusions and the recesses to engage. Altering the cutting edges is easy and quickly accomplished.

After assembly of the screw 132, the spring 130, and mounting cap 24 with the blade 26, the mounting cap 24 may be secured to the second handle 22 by any suitable means, such as sonic welding the handle 22 to the front base 120 of the mounting cap 24. As mentioned above, an adhesive or a mechanical fastener may be used as alternatives, for example, instead of welding.

When the scissors 10 is in the FIGS. 1-3 configuration, where the serrated edge regions 52, 54 are the cutting surfaces, a cut by the scissors will results in a generally sinusoidal wave design. When the straight edge regions 50, 56 are the cutting surfaces, a cut by the scissors results in a separation along a straight line. Alternately, if other configurations are used for the cutting edge regions of the blades, the cut design may be different and may be varied.

Any suitable material may be used for the blades, the mounting caps, and the handles. For a toy, a suitable plastic may be used. For added safety, rounded corners and large radii are incorporated in the design of the scissors. For adult tools, a suitable plastic or metal, such as steel, may be used.

In operation, the scissors 10 may be used in the usual fashion to cause a cut. When the material to be cut is modeling compound the scissors is also manipulated in the traditional manner. Two distinct cut designs may be achieved with the scissors because the blades have two different cutting edge regions and these are readily available simply by choosing the rotational positions of the blades. In an alternative embodiment, it may be advantageous and economic to provide only a single blade as having its longitudinal axis mounted to its handle to enable the single blade to individually rotate about its longitudinal axis between two positions for alternate operations. Play value of the modeling compound is increased because the scissors facilitates the creation of more designs. Being able to cut the modeling compound enhances play value. Being able to change the cut configuration made by the scissors enhances play value further.

The method that may be used by a manufacturer for mounting a scissor blade to a scissor handle to enable the scissor blade to be rotated around its longitudinal axis includes connecting the scissor blade to a mounting cap with a fastener and a coiled spring by placing the fastener through the coiled spring and through the openings in the mounting cap, and connecting the fastener to the scissor blade so that the spring is captured between the fastener and the mounting cap. By forming two spaced apart protrusions and two mating spaced apart recesses on the scissor blade and on the mounting cap, the blade is snuggly engaged with the mounting cap by the combination of mating protrusions and recesses, by the force of the biasing spring, and by a blade post mounted in the cap. The protrusions may be formed on the blade, as shown in FIG. 5, or they may be formed on the mounting cap. When the protrusions are formed on the mounting cap, the recesses may be formed on the blade. As mentioned above, the post acts as a shaft and a rear opening in the mounting cap acts as a bearing to insure smooth and steady operation. The mounting cap may then be connected to the scissor handle.

The scissors described in detail above is safe for a child, easy to use, incorporates robust construction, and is simple to assemble. The rotatable blade feature provides for a more efficient tool when compared to the usual fixed blade scissors.

From the foregoing, it can be seen that there has been provided features for an improved toy apparatus and a method of assembly for the rotatable scissor blades. While a particular embodiment of the present invention has been shown and described in detail, it will be obvious to those skilled in the art that changes and modifications may be made without departing from the invention in its broader aspects. Therefore, the aim here is to cover all such changes and modifications as fall within the true spirit and scope of the invention as expressed in the appended claims. The matters set forth in the foregoing description and accompanying drawings are offered by way of illustrations only and not as claim limitations. The actual scope of the invention is to be defined by the subsequent claims when viewed in their proper perspective based on the prior art.

What is claimed is:

1. A scissors assembly comprising:

a first handle;

a first blade at the first handle;

a second handle pivotally connected to the first handle; and a second blade at the second handle, wherein the first blade has first and second cutting edges and is rotatable relative to the first handle, the second blade has first and second cutting edges and is rotatable relative to the second handle, the first and second blades can be rotated to a first position where the first cutting edges can cooperate to perform a cutting function, and the blades can be rotated to a second position where the second cutting edges can cooperate to perform an alternate cutting function.

2. The scissors assembly of claim 1, wherein:

one of the cutting edges of the first blade is straight.

3. The scissors assembly of claim 2, wherein:

the other of the cutting edges of the first blade is serrated.

4. The scissors assembly of claim 1, wherein:

one of the two cutting edges of each of the first and the second blades is a straight cutting edge.

5. The scissors assembly of claim 4, wherein:

the other of the two cutting edges of each of the first and the second blades is a serrated cutting edge.

6. The scissors assembly of claim 1, comprising:

a first biasing spring connected between the first handle and the first blade; and a second biasing spring connected between the second handle and the second blade.

7. The scissors assembly of claim 1, comprising:

a cap and a fastener connecting the first handle with the first blade at the cap; and two spaced apart protrusions and two mating spaced apart recesses disposed between the first blade and the cap, wherein the first blade includes the two spaced apart protrusions and the cap includes the two mating spaced apart recesses.

8. The scissors assembly of claim 7, comprising:

a biasing spring connected between the first handle and the first blade.

9. The scissors assembly of claim 7, wherein:

one of the cutting edges of the first blade is straight.

10. The scissors assembly of claim 9, wherein:

the other of the cutting edges of the first blade is serrated.

11. The scissors assembly of claim 7, wherein:

one of the two cutting edges of each of the first and the second blades is a straight cutting edge.

12. The scissors assembly of claim 11, wherein:

the other of the two cutting edges of each of the first and the second blades is a serrated cutting edge.

13. A scissors assembly comprising:

a first handle;

a first blade having a longitudinal axis, the first blade being connected to the first handle to enable the first blade to rotate about the longitudinal axis between two positions, wherein the first blade has two cutting edges about 180° apart;

a second handle pivotally connected to the first handle;

a second blade at the second handle, wherein the second blade comprises a longitudinal axis, the second blade being connected to the second handle to enable the second blade to rotate about the longitudinal axis of the second blade between two positions the second blade further comprising two cutting edges about 180° apart, wherein the first blade is connected to the first handle through a first biasing spring, and the second blade is connected to the second handle through a second biasing spring; and said first blade mounted to a first cap with a first fastener wherein the first spring is captured between the first fastener and the first cap, and said second blade mounted to a second cap with a second fastener wherein the second spring is captured between the second fastener and the second cap, wherein each of the first and the second blades includes two spaced apart protrusions and each of the first and the second caps includes two mating spaced apart recesses.

14. The apparatus of claim 13, wherein:

one of the cutting edges of the first blade is straight.

15. The apparatus of claim 14, wherein:

the other of the cutting edges of the first blade is serrated.

16. The apparatus of claim 13, wherein:

one of the two cutting edges of each of the first and the second blades is a straight cutting edge.

17. The apparatus of claim 16, wherein:

the other of the two cutting edges of each of the first and the second blades is a serrated cutting edge.

18. The apparatus of claim 13, wherein:

the first cap is connected to the first handle; and the second cap is connected to the second handle.

19. The apparatus of claim 18, wherein:

the caps are connected to the handles by welding.

20. A scissor assembly comprising:

a first handle;

a first blade including a first cutting edge region and a separate second cutting edge region and having a longitudinal axis between said first and second cutting edge regions;

a biasing spring connected between the first handle an the first blade;

a second handle connected to the first handle;

a second blade at the second handle;

the first blade rotates to a first position and to a second position relative to the first handle and to the second blade;

a cap and a fastener connecting the first handle with the first blade at the cap; and two spaced apart protrusions and two mating spaced apart recesses disposed between the first blade and the cap, wherein the first blade includes the two spaced apart protrusions and the cap includes the two mating spaced apart recesses.

* * * * *